US007411165B2

(12) United States Patent
Wild et al.

(10) Patent No.: US 7,411,165 B2
(45) Date of Patent: Aug. 12, 2008

(54) PRODUCT STREAM HEATER

(75) Inventors: Hans-Peter Wild, Eppelheim/Heidelberg (DE); Bradley Gunn, Eppelheim/Heidelberg (DE); Klaus Lochbühler, Mannheim (DE)

(73) Assignee: INDAG Gesellschaft Fuer Industriebedarf mbH & Co. Betriebs KG, Eppelheim (DE)

( * ) Notice: Subject to any disclaimer, the term of this patent is extended or adjusted under 35 U.S.C. 154(b) by 371 days.

(21) Appl. No.: 10/865,327

(22) Filed: Jun. 10, 2004

(65) Prior Publication Data

US 2005/0019025 A1 Jan. 27, 2005

(30) Foreign Application Priority Data

Jun. 13, 2003 (EP) ..... 03013574

(51) Int. Cl.
*H05B 6/60* (2006.01)
*F27D 3/00* (2006.01)

(52) U.S. Cl. ..... 219/775; 432/239

(58) Field of Classification Search ..... 219/775, 219/776, 774; 198/198; 414/150; 432/239
See application file for complete search history.

(56) References Cited

U.S. PATENT DOCUMENTS

| | | | | |
|---|---|---|---|---|
| 2,473,881 | A * | 6/1949 | Hagopian | 219/776 |
| 2,546,004 | A | 3/1951 | Kinn | |
| 2,548,093 | A * | 4/1951 | Blewitt | 219/775 |
| 2,870,543 | A * | 1/1959 | Gard | 34/258 |
| 3,027,443 | A * | 3/1962 | Reed et al. | 219/769 |
| 3,149,217 | A * | 9/1964 | Reed et al. | 219/775 |
| 3,450,856 | A * | 6/1969 | Winkless et al. | 219/633 |
| 4,148,346 | A * | 4/1979 | Scarnecchia | 144/342 |
| 4,409,455 | A * | 10/1983 | Belcher et al. | 219/775 |
| 4,514,162 | A * | 4/1985 | Schulz | 425/174.8 R |
| 5,277,924 | A | 1/1994 | Padilla | |
| 5,834,746 | A | 11/1998 | Pedersen et al. | |
| 6,246,040 | B1 | 6/2001 | Gunn | |

FOREIGN PATENT DOCUMENTS

| | | |
|---|---|---|
| FR | 911170 | 7/1946 |
| JP | 57120046 | 7/1982 |
| JP | 04-103497 | 9/1992 |
| JP | 05-015792 | 3/1993 |
| JP | 2001-291574 | 10/2001 |
| SU | 819010 | 4/1981 |
| WO | WO-92/22180 | 12/1992 |

OTHER PUBLICATIONS

Search Report from Japanese Patent Office dated Aug. 16, 2005 (4 pages) English translation (8 pages).

* cited by examiner

*Primary Examiner*—Daniel Robinson
(74) *Attorney, Agent, or Firm*—Stroock & Stroock & Lavan LLP

(57) ABSTRACT

In an apparatus and a method for heating product streams, particularly food product streams containing fruits or fruit pieces, the product 47 flows through a product-carrying channel 2. The apparatus comprises means for generating high electrical alternating fields, wherein the means comprises electrodes, electrode terminals and an alternating field generator. The invention is characterized in that the electrodes are provided within the product-carrying channel.

33 Claims, 7 Drawing Sheets

PRODUCT STREAM HEATER

FIELD OF THE INVENTION

The present invention relates to an apparatus for heating product streams and, more particularly, for heating fruit or fruit pieces containing food product streams, wherein the apparatus comprises a product-carrying channel through which the product flows, and an apparatus for generating alternating fields, including electrodes, electrode terminals and an alternating field generator.

BACKGROUND OF THE INVENTION

Apparatus of this type are known in the art. Generally, the purpose of these apparatus is to heat products, and particularly food products, such that bacteria can be killed so as to achieve a prolonged shelf time of the product. Thereby, it is important that quality features, such as color, taste, consistency and texture do not significantly change. This is particularly important with fruit or fruit pieces containing food products as the structure of the fruits may readily be destroyed by heat. Therefore, the challenge resides in the fact that processing methods and apparatus have to be developed with which the desired characteristics of the products may be maintained as much as possible.

An apparatus for heating and sterilizing of products streams is known, for example from U.S. Pat. No. 6,246,040 B1. In the apparatus described therein, product streams moving in glass or Teflon tubes are electrically heated by strong electric alternating fields. To this end, radio frequency fields are applied to electrodes located outside of the tubes. Polar, i.e. electrically asymmetric, molecules contained in the product to be heated are subjected to a motion owing to their tendency to adjust to the electric field. Hence, the motion of the molecules produces heat. Hereinafter, this method of heating will be referred to as radio frequency heating. Such an apparatus enables a rapid and homogeneous heating even in non-homogeneous product mixtures. In these systems, a large portion of the energy, however, is lost in the walls of the tubes so that the efficiency of the apparatus is low. Moreover, due to the presence of high voltages, which may be generated by means of complex power electronics only, there exists the risk of spark breakthrough. For these reasons, the productivity of apparatus of this type is low and hence, the production costs are correspondingly high.

In another well known apparatus, a method of ohmic heating is used. Hereby, electric current flows through the medium to be heated. To this end, low-frequency voltage sources (up to 60 Hz) are used. The electrodes directly contact the product so that energy losses are maintained at very low levels. However, this method may successfully be used with homogeneous product streams only. Since, the product channels have to be relatively narrow (about 1 cm), this method may not easily be usable with fluids enriched with fruit pieces and the flow rates achieved are low. Moreover, there is a risk of electrolysis, thereby producing hydrogen. This results in a relatively short lifetime of the electrodes which are mostly made of carbon.

SUMMARY OF THE INVENTION

Therefore, it is an object of the present invention to provide an apparatus and a method that enable to safely and sparingly heat or sterilize product streams including inhomogeneous products, particularly fruit or fruit pieces containing fluids, in an efficient, energy saving and cost effective fashion at a high product yield.

In the apparatus according to the present invention, the electrodes are disposed in the interior of the channel carrying the product (hereinafter referred to as product-carrying channel), wherein a high-frequency electric field generated between the electrodes by means of an alternating field generator heats and, if necessary, sterilizes the product that is present in the channel. By high-frequency electric field, fields are meant having frequencies that are higher than the grid frequency and particularly having a frequency in the range of kHz-MHz. The electric alternating field enables an immediate and uniform heating of preferably dielectric materials, such as water molecules, with a deep penetration. Thereby, in particular, inhomogeneous products, such as food fluids enriched with fruits or fruit pieces are sparingly heated. The inventive solution avoids undue energy loss, since no additional material, such as a dielectric material, is present between the electrode and the product and hence, allows an efficient, energy saving and productive usage. Moreover, with such an apparatus, the response time is short which positively affects the temperature control.

Since the electrodes are in direct contact with the product, also an ohmic heating occurs in addition to the radio frequency heating, as an electric current may flow through the product. This effect may additionally increase the efficiency of the apparatus.

Preferably, the electrodes are located on opposite sides of the product-carrying channel, wherein the apparatus comprises at least one electrode pair. Oppositely arranged electrodes results in the creation of relatively homogeneous fields having substantially parallel field lines that are oriented substantially perpendicularly to the product stream.

In one advantageous embodiment of the present invention, the channels may be made of food safe dielectric material, thereby also enabling the insulation of the electrodes. However, other materials, particularly, ceramic materials, may also be used for the channel.

In another advantageous embodiment of the apparatus, the product-carrying channel may have a rectangular cross section. Hereby, large cross sections may be obtained, thereby ensuring a high product flow rate. Moreover, in large channels, also inhomogeneous fluids, such as food fluids enriched with fruit or fruit pieces, may be conveyed without resulting in undesirable plugging. Preferably, the corners of the channel are rounded to prevent the product from accumulating, so that the cleanliness of the product channels may be ensured for a prolonged time and the cleaning may be facilitated. Therefore, such a channel configuration is also usable for a process-internal cleaning (CIP).

Advantageously, the channel carrying the product may be composed of multiple, particularly of two, channel structural parts having substantially the same configuration. In case of a square cross section, the channel may, for instance, be comprised of two substantially U-shaped channel structural parts. Such structural parts may readily be formed and also enable to open the channel and to provide for an access to the electrodes in case of maintenance.

In one particularly advantageous embodiment, the cross section of the product-carrying channel is dimensioned such that by means of air pressure or a low pump power, the product may sparingly be conveyed to pass through the apparatus particularly from bottom to top. Due to the sparing transport of the product within the product-carrying channel, a high visual and flavorful quality of the product is possible, especially for transport of fruit or fruit pieces containing products.

Preferably, the electrodes are made of high grade steel, however, any food friendly stainless electrically conductive material may be employed. High grade steel ensures a long lifetime, and hence long maintenance intervals and also is relatively cost effective as high grade steel is a commonly used material.

The electrodes preferably have an extensive and oval shape, which is calculated such that in the interior of the channel a substantially homogeneous electric field is generated so as to enable an energy-transfer into the product stream, which corresponds to the various speeds of the product occurring within the channel. At the edge of the channel, where the product speed is lower, a correspondingly lower electric field is generated compared to the center, where the product speed is highest. By means of the electrode shape, it is therefore ensured that the energy deposition per volume element of the product and per dwell time is substantially identical for each product volume element in the apparatus so that the product stream is heated uniformly. At the same time, this results in a simplified process control. Hereby, a small product volume being present in the apparatus is to be understood as a product volume element. The sum of all product volume elements yields the total product stream.

A further preferred embodiment of the electrode shape relates to the feature that the edges of the electrodes at the side facing away from the channel wall are rounded. This prevents strong local electric fields from building up, which may otherwise lead to an overheating of the product in this area.

It is especially advantageous when the edges of the electrodes—particularly in combination with a channel formed of plastic or with a channel formed of a comparative material—are thickened at the side facing the channel wall, wherein the channel wall also has a recess corresponding to the thickened portion. This allows to fit in the electrode into the channel wall in a controlled fashion. Hereby, the thickened portion reproducibly fits into the corresponding recess. Thus, it is avoided, particularly by using a food safe silicone adhesive, that the product may accumulate behind the electrode. Moreover, this ensures an accurately defined position of the electrode within the channel. A further accomplishment is that the electrical field actually formed within the channel substantially corresponds to the field previously simulated.

Advantageously, the electrodes are connected with the electrode terminals located outside of the product-carrying channel with at least one screw or other fastening means allowing to exert tensile force. Hereby, the force acting between an electrode and the electrode terminal enables the electrode to be pressed on the channel wall and to be fixed, whereas, on the other hand, this also ensures simple replacement, if required.

The alternating field generator required for applying the alternating field voltage to the electrodes preferably generates square wave alternating voltages. Hereby, the frequency ranges from 100 kHz to 1000 kHz and particularly from 200 kHz to 500 kHz are preferable. Square wave alternating voltages have the advantage that they are composed of a superposition of many frequencies (Fourier analysis). The frequency spectrum hereby reaches from the kHz to the MHz region. Due to the presence of the frequency spectrum, long wavelength oscillations may be generated, which allow an even more homogeneous pervasion and hence, an even more uniform heating, particularly of inhomogeneous products.

Moreover, the alternating field generator generates voltages up to one kV and particularly, voltages of 500 V at a current in the range of up to 100 A and in particular, in the range of 50-60 A. The relatively low voltage at simultaneously relatively high currents brings about a plurality of advantages. On the one hand, the risk of a spark breakthrough is minimized due to the low voltage. This is especially advantageous, when gas bubbles are present within the product. On the other hand, the high currents enable the transfer of high energies, thereby resulting in an efficient heating of the product. Additionally, the channel cross section may be selected sufficiently large so as to guarantee a high product throughput. At the same time, the length of the apparatus remains short, thereby rendering the apparatus compact and also the cleaning of the apparatus is facilitated. The electric characteristics described above may be achieved by standard power electronic devices, thereby enabling to realize the apparatus in a cost effective and maintenance-friendly fashion.

The interface between the alternating feed generator and the electrode terminals is configured such that the alternating field generator may be connected without any additional wiring. In one especially simple and thus maintenance-friendly embodiment, the alternating field generator is attached without tools.

Preferably, stiffening elements may be arranged at the outer side of the channel so as to provide protection against the deformation of the dielectric channel material. Owing to relatively high pressures in the interior of the product channel, possibly undesirable deformation of the channel may occur, thereby negatively affecting the shape of the electric fields, or the functionality of the apparatus may be limited owing to leaking portions. Stiffening elements, particularly metal plates made of, for example high grade steel, counteract such a possible deformation and hence, promote an enhanced lifetime of the apparatus.

In a further inventive embodiment, the product-carrying channel is formed of a plurality of subunits that are arranged in series in a sealing fashion along the product stream direction. Each subunit comprises at least an electrode pair, corresponding electrode terminals and a number of alternating field generators corresponding to the number of electrode pairs, wherein each of the generators includes its own controller. Hence, the apparatus may be individually adapted depending on the products and depending on the required heating power. The stepwise configuration of the heating apparatus including subunits connected in series additionally offers the possibility of a precise temperature control and regulation.

To this end, the subunits may advantageously be distorted with each other by appropriate means, such as screws, wherein between each two subunits sealing means may be inserted into a recess. This recess may be located on at least one of the two apparatus interfaces and may enclose the product-carrying channel. As sealing means, an O-ring may be used for example. In the case of required maintenance, such as the replacement of the electrodes, the various subunits may be dismantled in such a way that the electrodes within the channel may be manually accessed.

Alternatively, the sealing may also be achieved without additional sealings, particularly by gluing, especially in the case of channels made of plastic. The glued portions may be reinforced in that the above described recess is present on one of the interfaces, whereas a sealing protrusion corresponding to the shape of the recess is provided on the interface of the subsequent subunit. By this measure, undesired lateral forces acting on the glued portions may be avoided.

In a further preferred embodiment, the apparatus for heating product streams may further comprise a cleaning module. One of the maintenance operations, required on a regular basis, is the cleaning of the product-carrying channel. By means of a permanently installed cleaning equipment, this operational step may be performed without any delay, if it is required or planned. A heating apparatus or a sterilizing apparatus may, therefore, be composed of a plurality of subunits and cleaning units. An embodiment is that includes two subunits, each having five electrode pairs, wherein cleaning modules are provided between the subunits and also at the beginning and at the end of the entire heating unit.

Advantageously, the cleaning module comprises a product-carrying channel, particularly made of high grade steel, which has substantially the same cross section as the apparatus and which includes, within the product-carrying channel, a showerhead which is connected with a fitting attached to the outside of the cleaning module and through which a cleaning medium, particularly water, is conveyed into the interior of the product-carrying channel through the showerhead. By means of such a cleaning module, the product-carrying channel may thoroughly be cleaned and thus, contributes to the hygienic quality of the product to be heated.

In one embodiment preferred with respect to ordering, the cleaning modules comprise at least one continuous opening that is substantially parallel to the direction of the channel. By means of a tie rod having a diameter that substantially corresponds to the diameter of the opening, multiple subunits may be stringed together, centered and distorted with each other.

According to the inventive method, the product being present in the channel and generally moving is heated and, as the case may be, sterilized by a high frequency electric field, which is generated between two electrodes by means of an alternating field generator. Hereby, the electrodes are located within the product-carrying channel. The electric alternating field enables an immediate and uniform sparing heating of preferably dielectric materials, while deeply penetrating the product. Particularly, the structure of solid components within the product, particularly of fruits or fruit pieces, is substantially maintained. The inventive method avoids undue energy loss, since no additional material is disposed between the electrode and the product and hence, the method is efficient, energy saving and productive. Furthermore, with this method, the response time is extremely short, which has a positive influence on the temperature control.

BRIEF DESCRIPTION OF THE DRAWINGS

Embodiments of the present apparatus in accordance with the invention as well as inventive methods will be described by referring to the accompanying drawings, in which.

DETAILED DESCRIPTION

Figure 1:
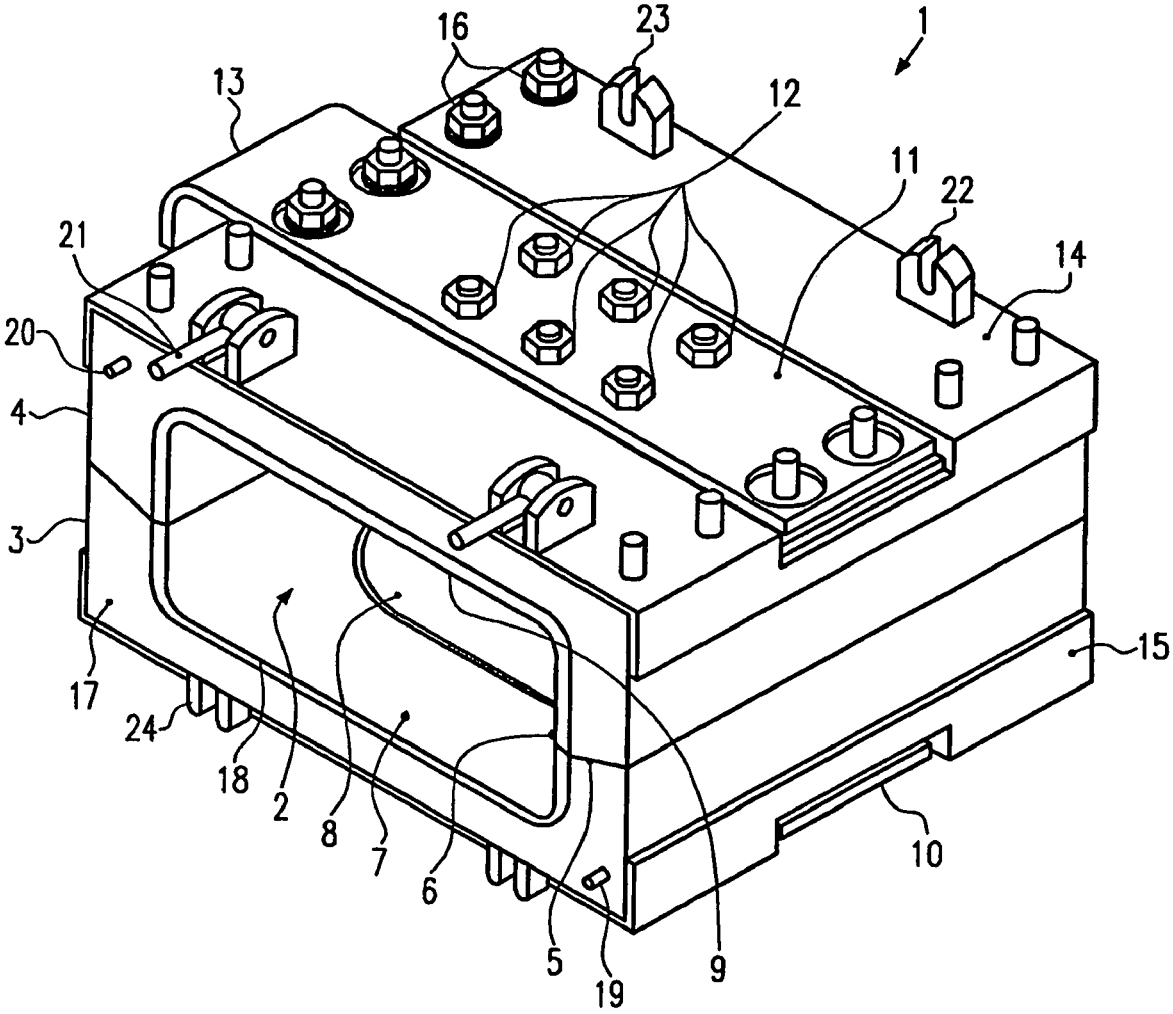
FIG. 1 is a perspective view of a first embodiment of the inventive apparatus.

FIG. 1 shows in a perspective view the basic configuration of the inventive apparatus 1. The product-carrying channel 2 is composed by two structural parts 3 and 4, having substantially the same configuration. The two structural parts 3 and 4 are arranged side by side in a sealing manner and are typically adhered or glued to each other. At the interface 5 between the structural part 3 and 4, a slot/key combination 6 is provided, in the present example located at the side of the structural part facing the channel. By means of this slot/key combination 6, the adhesion strength is increased. It goes without saying that gluing is merely one possibility to connect the two channel structural parts 3 and 4 with each other, and these structural parts may also be connected with each other by means of screws 16. The channel structural parts 3 and 4 may be made of food safe dielectric material, such as PTFE, polysulfon or PEEK.

Within the channel 2, two electrodes 8 and 9, having substantially the same shape, are arranged on oppositely located sidewall surfaces 7. Typically, these electrodes 8, 9 are made of high grade steel. The electrodes 8, 9 are electrically connected to electrode terminals 10 and 11 located outside and typically formed of aluminum or brass, wherein the electrical connection is provided, for example by straining screws 12. In this embodiment, the straining screws 12 also serve the purpose of fixing the electrodes 8 and 9. The electrode terminals 10 and 11 are connected with the square wave alternating field generator which is not shown here, by means of links 13 (here the link is shown for the electrode terminal 11 only). In order to prevent a deformation of the channel structural parts 3 and 4 possibly caused by relatively high pressures in the range of up to approximately 8 bar, particularly 6 bar, stiffening plates 14 and 15 are arranged on the outer side of the channel structural parts 3 and 4. The stiffening plates 14 and 15 may be fastened by the screw 16 or may be fixed by adhering to the channel structural parts 3 and 4. In the embodiment shown in which the shape of the product-carrying channel 2 is rectangular, the stiffening plate 14 or 15 covers at least a portion of the wide and narrow side of the channel structural parts 3 or 4, wherein in this example the area covered by the electrode terminal 10 or 11 is left open such that the stiffened plate and the electrode terminal do not contact each other. An appropriate material for stiffening the housing is, for example high grade steel.

The apparatus described above represents a subunit. This subunit may be connected to other subunits having the same configuration so as to allow the formation of a continuous product channel of arbitrary length, depending on the desired product throughput. For this reason, the apparatus 1 includes connecting and sealing means so as to couple the subunits with each other in a sealing fashion. A recess 18 is located on the interface adjacent to the subsequent subunit 17 that encloses the product channel 2, wherein sealing means may be introduced into the recess. Appropriate sealing means may include for instance an O-ring sealing, a flat packing or silicones. In the embodiment shown, the recess is located immediately next to the product-carrying channel 2, may, however, be in principle located at an arbitrary position of the interface to the subsequent subunit 17. Alternatively, the recess 18 may be provided at one side of the subunits only, or may be provided on both sides. In order to relatively center two subunits to each other, the channel structural parts each include at least one bolt 19 and 20 protruding outwardly and being located on the interface to the subsequent subunit 17. These bolts 19 and 20 penetrate corresponding recesses (not shown herein) in the other subunit upon bringing together two subunits and, therefore, center the two subunits relatively to each other.

Reference sign 21 denotes bolts that rotatively run on bearings whose rotation axis is registered to the interface 17 in a substantially parallel fashion. The support of the bolt 21 rotatably running on bearings is connected with stiffening plates 14 and is located in the vicinity of the interface 17 to the subsequent subunit. Located on the opposite side of the second interface 22 to a further subsequent subunit, there are counter pieces 23 for the bolt 21 rotatably running on bearings. These counter pieces are, as are the rotatably supported bolts 21, located on the stiffening plate 14 in the vicinity of the interface 22. Identical bolts rotatably running on bearings (not shown herein) and respective counter pieces 24 are also provided on the stiffening plate 15 of the second channel structural part 3, wherein, in this embodiment, on each cut surface 17 or 22 bolts rotatably running on bearings are provided on the one side, while the respective counter pieces are provided on the other side. Hereby, the precise arrangement of the bolts and the counter pieces is not critical for the invention. The bolts 21 rotatably running on bearings and the respective counter pieces serve the purpose to attach two subsequent subunits to each other. The mechanism is described in more detail with reference to FIG. 4.

Figure 2A:
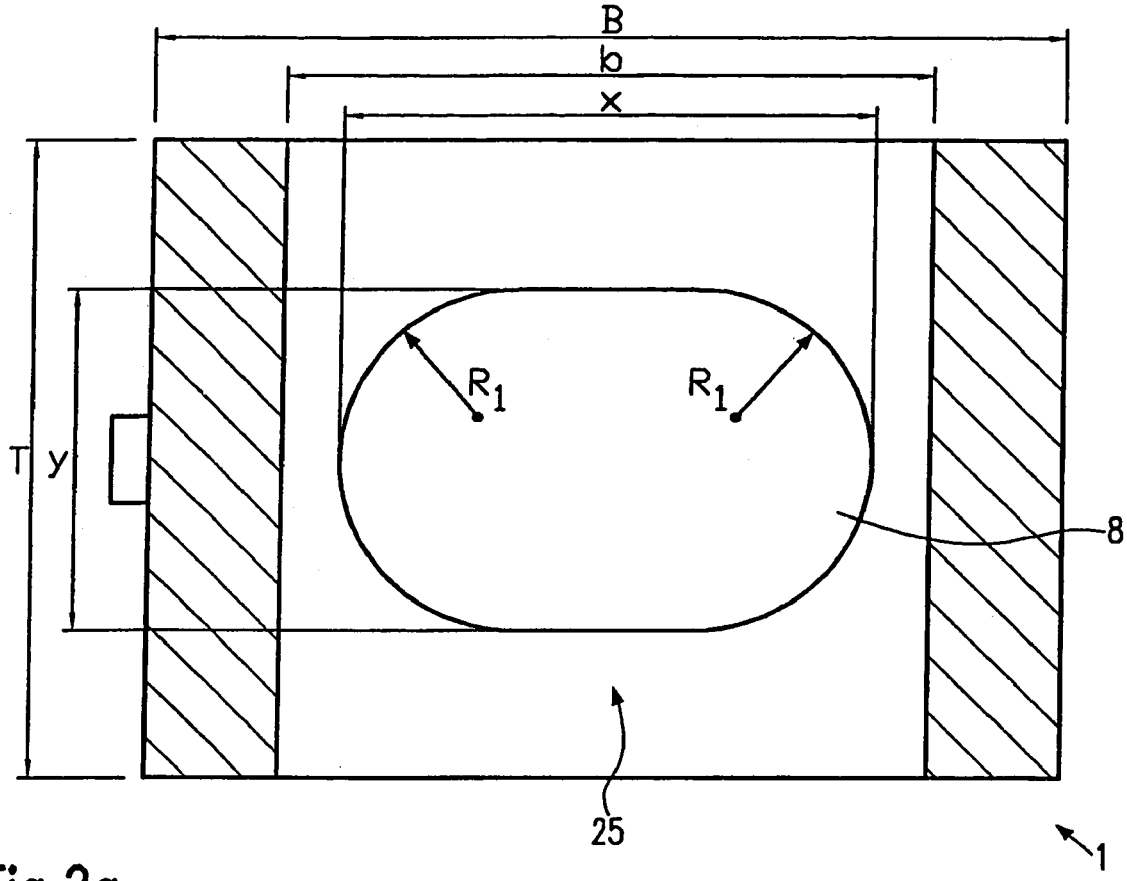
FIG. 2*a* is a detailed diagram in the form of a plan view of an electrode embedded into the channel wall.
Figure 2B:
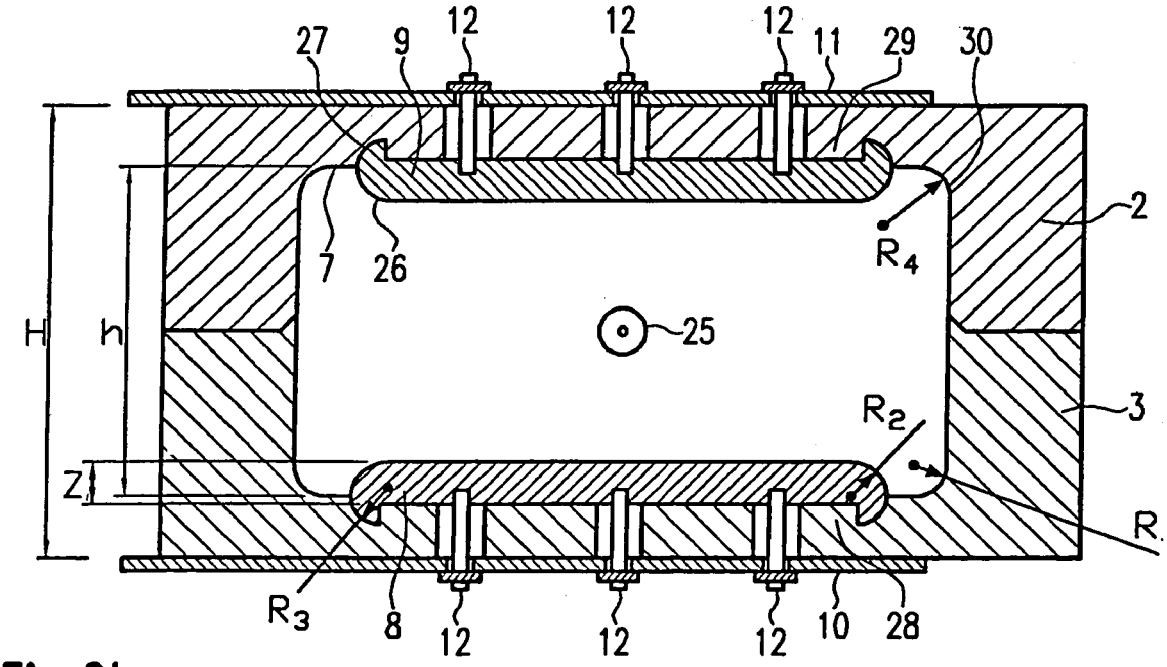
FIG. 2*b* is a detailed illustration in cross sectional view of an electrode embedded into the channel wall.

FIGS. 2*a* and 2*b* show a detailed illustration of an inventive embodiment of the electrodes. In FIG. 2*a*, there is shown a section along the length direction of the product stream 25 and parallel to the electrodes 8 and 9, whereas FIG. 2*b* shows a cross section taken laterally to the product stream 25 at the position of the straining screws 12.

FIG. 2*a* shows a plan view of the lower portion of the apparatus 1. As is shown in FIG. 2*a*, the electrode 8 has an area-like or sheet-like shape, wherein the sides parallel to the flow direction of the product stream 25 and towards the channel walls are rounded. This results in an oval shape. Hereby, the radius R1 of the rounding is approximately half of the depth Y of the electrode.

In FIG. 2*b* there is shown a rounding 26 of the electrodes 8 and 9 on their respective edges. On the side facing the channel wall 7, the electrodes 8 and 9 have a thickened portion 27, which particularly has, partly, a rounded shape having a radius R3 that approximately corresponds to the thickness Z of the electrode. On the area covered by the electrodes 8 and 9, the channel wall 7 is left open or recessed corresponding to the shape of the electrodes 8 and 9, wherein the electrodes 8 and 9 are inserted into the channel wall 7 approximately up to the half of their thickness Z. If necessary, the electrodes 8 and 9 may be entirely inserted into the structural parts 3 and 4 or the electrodes may possibly rest thereon. The electrodes 8 and 9 are connected to the respective electrode terminals 10 and 11 by means of the straining screws 12. These may establish the electrical contact and may also fix the electrodes 8 and 9 in a sealing fashion. Additionally, in portions 28 and 29 behind the electrodes, sealing means may be provided, such as for instance flat packings. Alternatively, the electrodes 8 and 9 may be adhered to the structural parts 3 and 4 by means of a food safe adhesive, such as a silicone adhesive. FIG. 2*b* also shows the rounded corners 30 of the channel. The rounding radius R4 is typically substantially less than half of the height H of the channel.

For a liquid food product enriched with fruits or fruit pieces, for example the following dimensions of the apparatus (without alternating field generator) are usable:

width B 100 mm to 600 mm, particularly B=350 mm, height H 50 mm to 250 mm, particularly H=150 mm, and depth T 50 mm to 450 mm, particularly T=250 mm, with a channel having a width b of 50 mm to 550 mm, particularly b=250 mm, a height h of 30 mm to 230 mm, particularly h=to 95 mm, and a rounding radius R4 of 0 mm to 115 mm, particularly R4=10 mm. Thereby, the electrodes 8 and 9 have a width x from 30 mm to 500 mm, particularly x=250 mm, a depth y from 20 mm to 450 mm, particularly y=135 mm, and a thickness z from 5 mm to 25 mm, particularly z=10 mm. The side rounding radius R1 of the electrodes 8 and 9 is approximately 0 mm to 225 mm, and particularly 67.5 mm, the electrode rounding radius R2 is approximately 0 mm to 12.5 mm, particularly R2=5 mm and the radius R3 of the thickened portion is approximately 0 to 25 mm, and particularly R3=10 mm.

Figure 3:
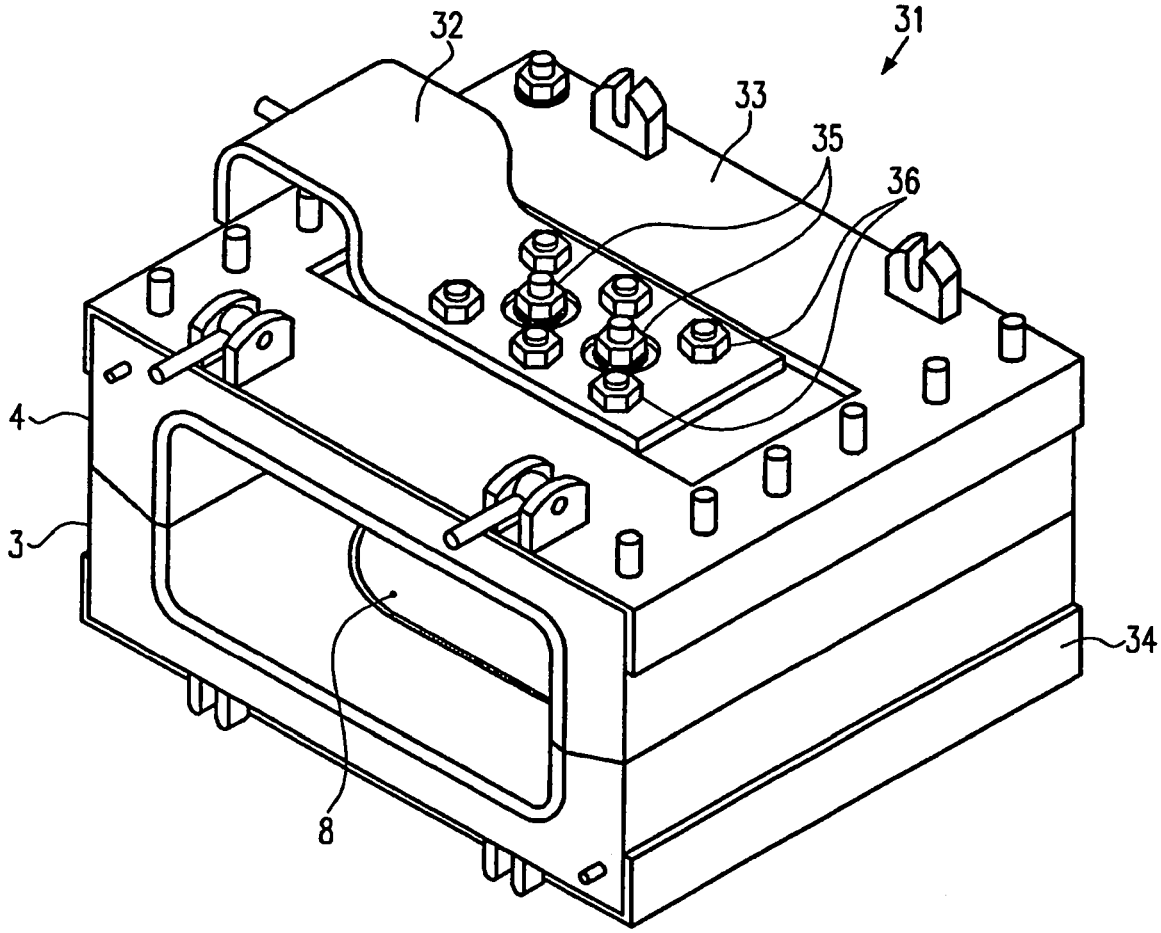
FIG. 3 is a perspective view of a second embodiment of the inventive apparatus.

FIG. 3 shows an alternative embodiment 31 of the inventive apparatus. The embodiment having substantially the same configuration differs from the preceding embodiment by two aspects. Compared to the electrode terminal 11 of the first embodiment, the contact area of the electrode terminal 32 of the second embodiment is smaller. Towards the AC generator, which is not shown herein, the electrode terminal 32 substantially forms a U-shape and no longer rests on the channel structural part 4. Also, at the side opposite to the alternating field generator, the electrode terminal 32 is shortened compared to the electrode terminal 11 (exemplary embodiment 1). Since the support surface of the electrode terminal 32 on the channel structural part is less compared to first exemplary embodiment, the stiffening plate 33 may be provided with an increased surface, thereby resulting in an improved strength of the apparatus 31 compared to the first exemplary embodiment. It should be appreciated that the electrode terminal belonging to the second electrode 8 has a shape equivalent to the electrode terminal 32. The same holds true for the stiffening plate 34 of the second channel structural part 3.

Moreover, a further difference of the embodiment 2 is a different way of attaching and contacting the electrodes with the channel structural parts and the electrode terminals, respectively, wherein the attachment of the electrodes is separated from the contacting. Hereby, the electrodes are attached to the channel structural parts 3 or 4 by means of electrode attachment screws 35, without contacting the electrode terminals 32. The electrical contact between the electrodes and the electrode terminal 33 is established by contact means, such as for instance six screws 36 in this example. This embodiment brings about the advantage that in case of defective electrode terminals, the electrodes may remain in position or vice versa, thereby facilitating maintenance operations. The dimensions substantially correspond to the dimensions of the first exemplary embodiment.

Figure 4:
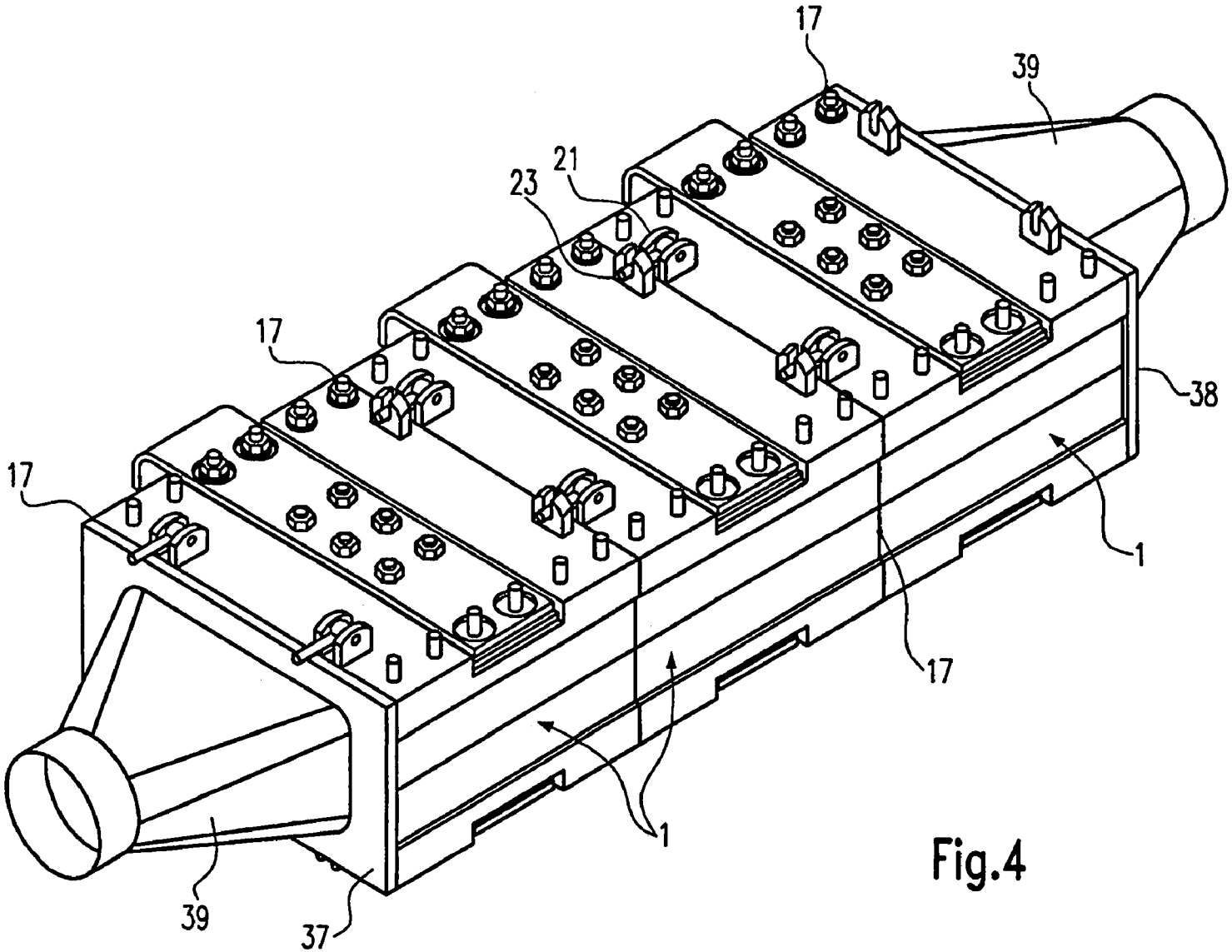
FIG. 4 is a perspective overview of a product stream heater including a plurality of subunits connected in series.

FIG. 4 schematically shows an overview of three subunits 1 connected in series of the first exemplary embodiment. The three subunits 1 connected in series are completed at ends 37 and 38 by fitting tubes 39. At the interfaces 17 to the respective subsequent subunits or the fitting tube 39 it is evident, how the subunits may be attached to each other and also how the leading or trailing subunits may be connected with the respective fitting tube 39 by inserting the bolts 21 rotatably running on bearings into the corresponding counter piece 23. In the exemplary embodiment shown, three successive subunits are used, however, depending on the application of the product stream heater, an arbitrary number of subunits may be connected in series.

Figure 5:
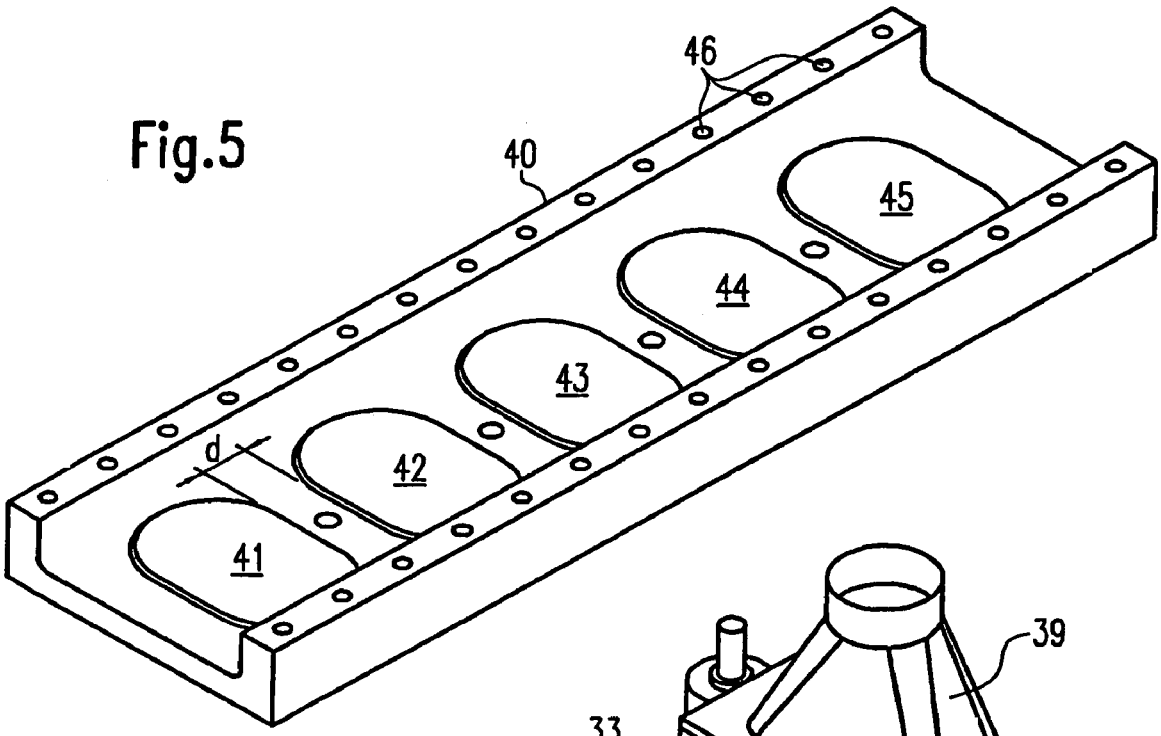
FIG. 5 is an embodiment of a channel-forming half shell having five electrodes.

FIG. 5 shows an alternative for connecting subunits of identical configuration in series. Depending on the number of desired electrode pairs, also the length of a channel structural part 40 may be adapted. In the exemplary embodiment shown, for example five electrodes 41 to 45 may be arranged within a single channel structural part 40. Hereby, the dimensions of the electrodes 41 to 45 correspond to the dimensions of the electrodes 8 and 9 described in FIGS. 2*a* and 2*b*. In the exemplary embodiment shown, the electrodes 41 to 45 have a spacing of approximately 50 mm. The plurality of openings or holes 46 in the wall of the channel structural part 40 are used for attaching the two required channel structural parts by means of screws. Alternatively, the channel walls may be glued together.

Figure 6:
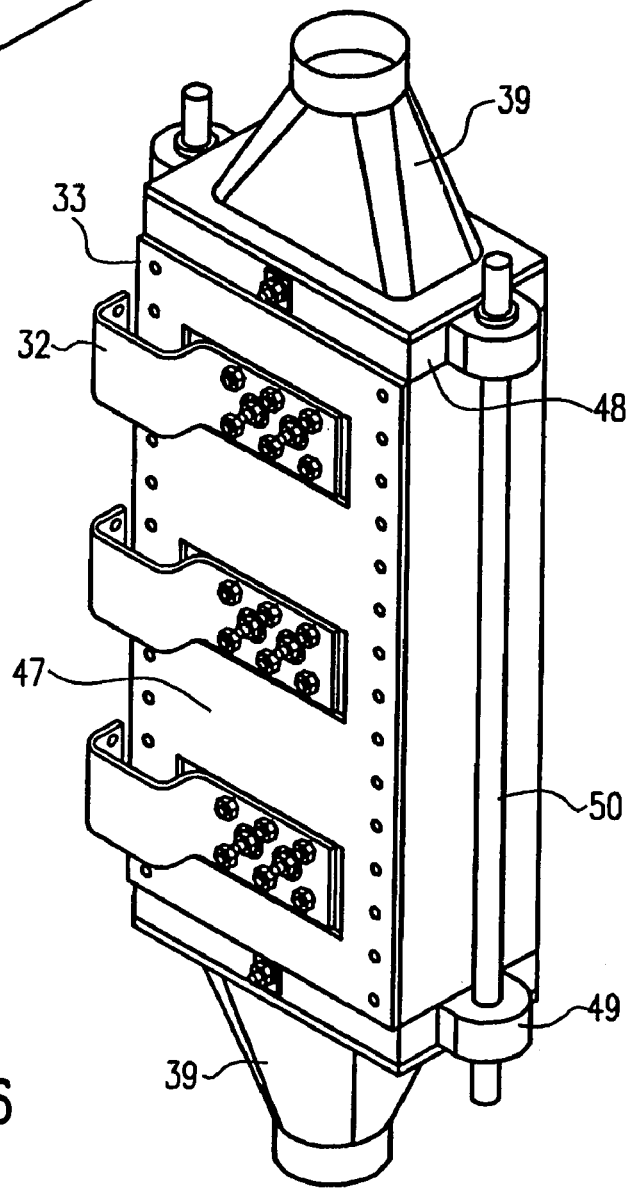
FIG. 6 is a perspective view of a cleaning module.

FIG. 6 shows the application of the structural parts as described in FIG. 5 in a product stream heater. In this example, structural parts 47 having three electrodes (not shown) are used. Regarding the shape of the electrode terminals 32 and of the stiffening plate 33, the second exemplary embodiment as shown in FIG. 3 is used here. The apparatus is completed by cleaning modules 48 and 49 provided on both ends, which will be discussed in more detail with reference to the following FIG. 7. Next to the cleaning module 48, 49 the fitting tubes 39 are provided. The cleaning modules 48, 49 are distorted with each other by means of two tie rods 50 and 51. By means of this tie rod device, the three elements, the two cleaning modules and the subunit are connected with each other in a sealed and centered fashion.

Figure 7:
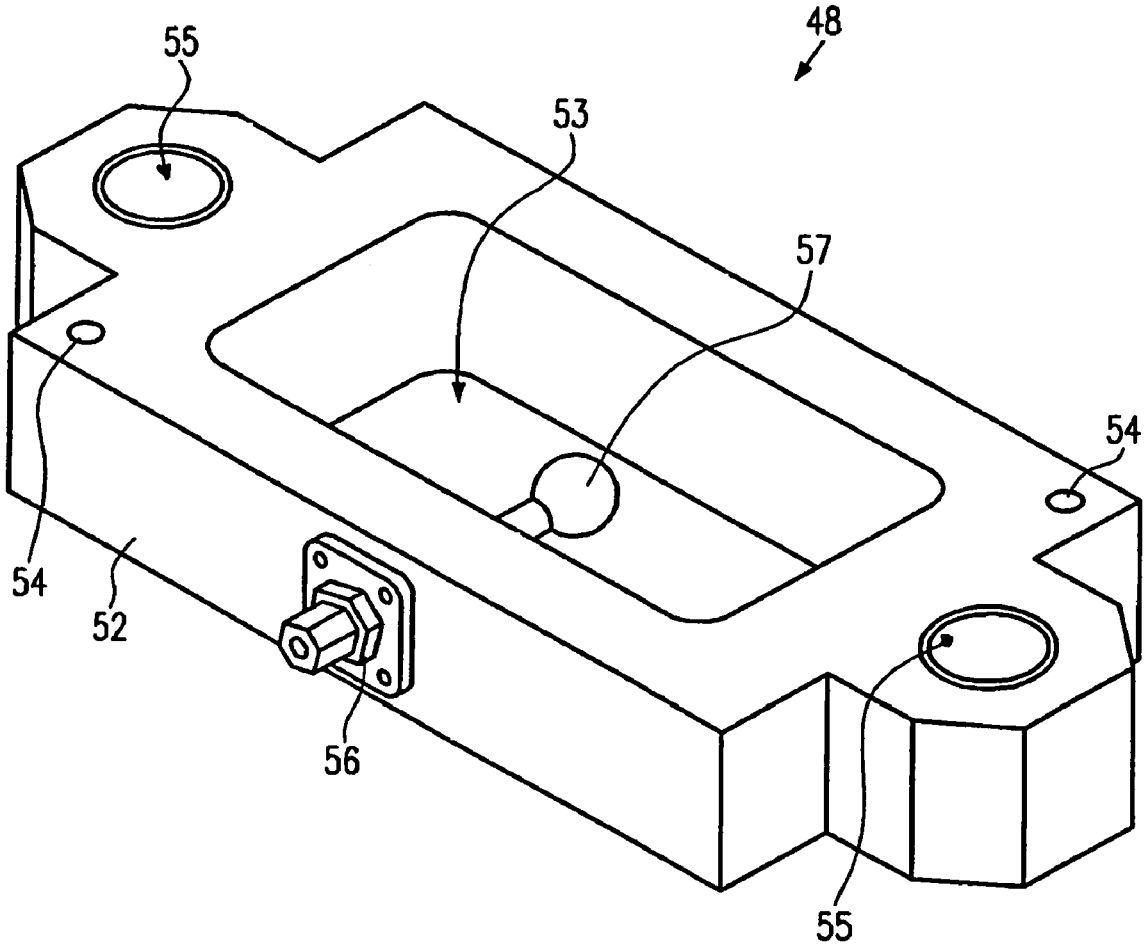
FIG. 7 is a perspective overview of a product stream heater having a plurality of subunits connected in series and two cleaning modules.

FIG. 7 is a perspective detailed illustration of the cleaning module 48. In the embodiment shown, the cleaning module is composed of a single structural part 52, wherein of course the possibility exists that the body of the cleaning module 48 may be composed of two or more structural parts having substantially the same configuration. The structural part 52 defines a channel 53, the shape of which substantially corresponds to the shape of the product-carrying channel 2 of the subunits 1 and 31, respectively. Reference numeral 53 denotes centering recesses serving the purpose of registering the cleaning module 48 with respect to the subsequent subunits 1 or 31, which have registered bolts 19 or 20. Guide openings 55 are formed on the sides of the structural part 52, through which the tie rods 50 or 51 are passed. A pipe conveying a cleaning fluid or a hose conveying a cleaning fluid may be connected to the fitting 56. By means of a channel (not shown) provided in the structural part 52 of the cleaning module, the cleaning agent may enter the showerhead 57 and may be sprayed through openings formed in the showerhead into the interior of the channel 53 and the product-carrying channel 2, respectively. In the exemplary embodiment, a centrally arranged showerhead is shown; however, a plurality of small showerheads may be provided, especially at the perimeter of the channel 53.

For a food product enriched with fruits or fruit pieces, a product stream heater having 2×5 electrode pairs connected in series has proven to be particularly effective. Hereby, at the end of the product entry and at the end of the product exit, a cleaning module is provided and an additional cleaning module is located in the center of the apparatus, that is, after five subsequent electrode pairs. For the application, it is not critical whether the apparatus is used in a horizontal position or in a vertical position, wherein the support surface of the apparatus is reduced when using the same in the vertical position.

Figure 8:
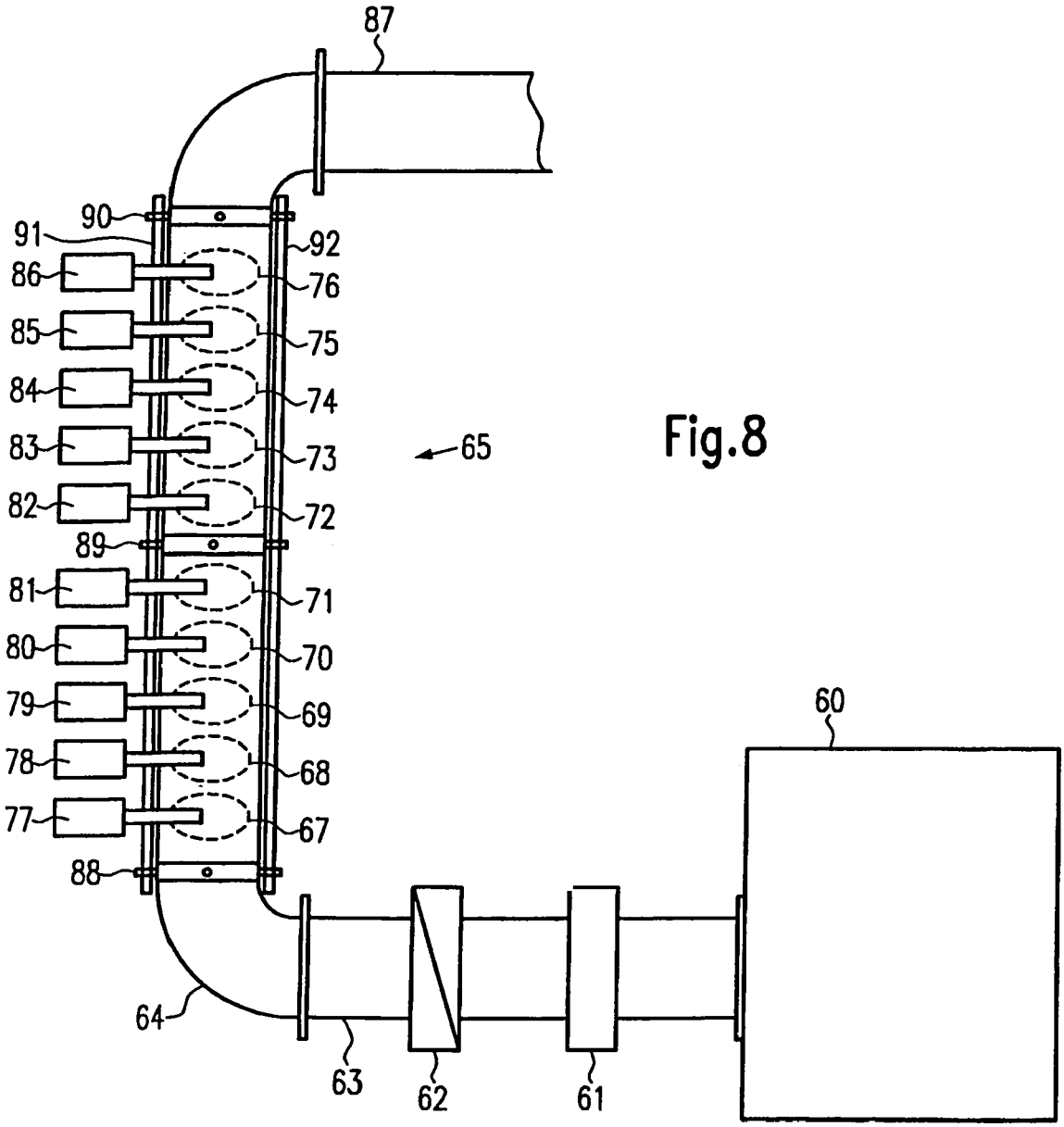
FIG. 8 is a schematic view of a production line having a product stream heater.

Referring to FIG. 8, which schematically shows the entire configuration of a product stream heater, the inventive method using the inventive apparatus will now be described. The liquid food product enriched with fruits or fruit pieces that is to be heated is provided in a storage container 60. The fruit product is moved within a channel 63 by means of a pump 61 after valves 62 have been opened. After passing a curved fitting 64, the liquid enters the product stream heater 65. As shown, the product is fed into the product stream heater 65 at the bottom and then flows substantially vertically upwards through the product stream heater 65. Hereby, the product passes by, in total, ten electrode pairs 67 to 76. Each of the electrode pairs is connected to one of square wave generators 77 to 86. Typically, square wave alternating voltages of approximately 500 volts with currents of approximately 50 to 60 A and a frequency of approximately 200 to 500 kHz are applied to the electrodes 67 to 76. As a result, strong electric alternating fields are created within the product-carrying channel, thereby heating the product stream. Typically, in the example shown, heating rates of approximately 80° C. per minute and a maximum temperature of about 130° C. are achieved. After the heating step, the product stream flows into the discharge channel 87 and may be further processed in a subsequent apparatus (not shown).

The apparatus may be turned off on a regular basis and the product stream heater 65 may be cleaned by means of the cleaning modules 88 to 90 provided therein. For a possible maintenance of the electrodes, the product stream heater may be dismantled relatively fast by means of the tie rods 91 and 92, in that the cleaning modules are pushed away so as to facilitate access of the electrodes.

The invention claimed is:

1. An apparatus for heating product streams, particularly food product streams containing fruit or fruit pieces, comprising:

a product-carrying channel, constructed and arranged to receive food product streams; and electrodes that are area-like and have an oval shape for receiving a high frequency electronic alternating field signal, wherein the electrodes are disposed within the product-carrying channel and are thickened at their edges at the side facing the channel wall, and whereby a recess corresponding to the shape of the electrode is located in the channel wall of the product-carrying channel.

2. The apparatus of claim 1, wherein the electrodes are disposed on opposite sides of the product-carrying channel, whereby the apparatus comprises at least one electrode pair.

3. The apparatus of claim 1, wherein parts forming the product-carrying channel are made of food safe dielectric material.

4. The apparatus of claim 1, wherein the product-carrying channel has a cross section of rectangular shape, the corners of which are rounded.

5. The apparatus of claim 1, wherein the product-carrying channel is formed of a plurality of structural parts having substantially the same configuration.

6. The apparatus of claim 1, wherein the cross section of the product-carrying channel is dimensioned so as to enable to move the product by one of air pressure or low pump power with up to 4 tons per hours and to flow the product through the apparatus.

7. The apparatus of claim 1, wherein the electrodes are formed of stainless material.

8. The apparatus of claim 1, wherein the electrodes are rounded at their edges at the side facing away from the channel wall.

9. The apparatus of claim 1, wherein the electrodes are connected to electrode terminals located outside of the product-carrying channel by at least one fastening element.

10. The apparatus of claim 1, wherein the alternating field generator is configured to generate voltages up to approximately 1 kV at the electrodes and to generate currents up to 100 A.

11. The apparatus of claim 1, wherein the alternating field generator comprises an interface corresponding to the shape of the electrode terminal for connection without cables.

12. The apparatus of claim 11, wherein the interface of the alternating field generator is configured such that the electrode terminals may be connected without tools.

13. The apparatus of claim 1, wherein stiffening elements provided at the outer side of the channel constructed and arranged to protect against deformation.

14. The apparatus of claim 1, wherein the product-carrying channel is formed of a plurality of subunits arranged in a series along a direction of the product stream in a sealing fashion, with each subunit including interfaces.

15. The apparatus of claim 14, wherein each subunit includes on at least one of the interfaces intersecting the product-carrying channel a recess enclosing the product-carrying channel, in which a sealer constructed and arranged for sealing the interface of two apparatus are inserted and a connector is provided to connect the apparatus in a sealing fashion.

16. The apparatus of claim 14, wherein the subunit includes on one of the interfaces intersecting the product-carrying channel a recess enclosing the product-carrying channel and includes on the other interface intersecting the channel a protrusion corresponding to the shape of the recess, and whereby a connector is provided to connect to the apparatus in a sealing fashion.

17. The apparatus of claim 1, wherein the apparatus additionally comprises a cleaning module.

18. The apparatus of claim 17, wherein the cleaning module comprises a product-carrying channel having substantially the same cross section as the apparatus and including a showerhead within the product-carrying channel, said showerhead being connected to a fitting attached to the outside of the cleaning module, and being configured to pass a cleaning medium through the showerhead into the interior of the product-carrying channel.

19. The apparatus of claim 17, wherein the cleaning module comprises, at least one further continuous opening that is substantially parallel to the direction of the channel.

20. The apparatus of claim 5, wherein the plurality of structural parts comprises two structural parts.

21. The apparatus of claim 6, wherein the power is 3 tons per hour.

22. The apparatus of claim 6, wherein the flow of product through the apparatus is from bottom to top.

23. The apparatus of claim 7, wherein the stainless material is high grade steel.

24. The apparatus of claim 9, wherein the fastening element is a screw.

25. The apparatus of claim 18, wherein the product-carrying channel is formed of high grade steel.

26. The apparatus of claim 18, wherein the cleaning medium is water.

27. The apparatus of claim 1, wherein the electrodes are constructed and arranged to physically contact the food products.

28. The apparatus of claim 1, wherein the apparatus is substantially leak proof.

29. The apparatus of claim 1, wherein the electrodes are selectively removable.

30. The apparatus of claim 1, wherein the product path is constructed and arranged to receive liquids.

31. The apparatus of claim 1, comprising one or more pumps for moving the food product stream.

32. The apparatus of claim 1, wherein the alternating field generator is configured to generate square wave alternating voltages in a frequency range of approximately 100 kHz to 1000 kHz.

33. The apparatus of claim 32, wherein the frequency range of is approximately 200 kHz to 500 kHz.

* * * * *